US008911280B2

(12) United States Patent
Franklin et al.

(10) Patent No.: US 8,911,280 B2
(45) Date of Patent: Dec. 16, 2014

(54) APPARATUS FOR SHAPING EXTERIOR SURFACE OF A METAL ALLOY CASING

(75) Inventors: Jeremy C. Franklin, San Francisco, CA (US); Kevin Gibbs, Menlo Park, CA (US); Christopher J. Stringer, Woodside, CA (US); Daniel J. Coster, San Francisco, CA (US); Donald Q. Ross, III, San Jose, CA (US); David Kim, Shenzhen (CN); Chuan You Su, Shenzhen (CN); Max A. Maloney, Menlo Park, CA (US); Erik D. Gillow, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 519 days.

(21) Appl. No.: 13/018,242

(22) Filed: Jan. 31, 2011

(65) Prior Publication Data

US 2012/0196510 A1 Aug. 2, 2012

(51) Int. Cl.

| | |
|---|---|
| ***B24B 49/00*** | (2012.01) |
| ***B24B 51/00*** | (2006.01) |
| ***B24B 7/20*** | (2006.01) |
| ***B24B 19/26*** | (2006.01) |
| ***B24B 19/00*** | (2006.01) |

(52) U.S. Cl.

CPC ..... *B24B 19/26* (2013.01); *B24B 19/009* (2013.01)

USPC ..... 451/5; 451/58; 451/162; 451/178; 451/541

(58) Field of Classification Search

CPC ..... B24B 37/005; B24B 49/00; B24B 51/00; B24B 13/01; B24B 19/26; B24B 9/00; B24B 1/005; B24B 1/002; B24B 7/075; B24B 27/003; B24D 7/18; Y10S 451/913

USPC ..... 451/5, 11, 57, 58, 120, 124, 162, 164, 451/178, 541, 913; 700/164, 187

See application file for complete search history.

(56) References Cited

U.S. PATENT DOCUMENTS

| | | | | |
|---|---|---|---|---|
| 1,576,645 | A * | 3/1926 | Eskew et al. | 144/115 |
| 3,540,162 | A * | 11/1970 | Blackmer et al. | 451/547 |
| 3,885,925 | A * | 5/1975 | Tatar | 451/48 |

(Continued)

FOREIGN PATENT DOCUMENTS

| | | |
|---|---|---|
| CN | 101540451 | 9/2009 |
| CN | 201491423 | 5/2010 |

(Continued)

*Primary Examiner* — Timothy V Eley

(74) *Attorney, Agent, or Firm* — Brownstein Hyatt Faber Schreck, LLP

(57) ABSTRACT

A method and an apparatus for machining an exterior surface of a metal alloy casing of a portable electronic device to form a combination of a flat edge surface, a curved edge surface and a flat bottom surface is disclosed. The flat edge surface is abraded by contacting a first flat section of a rotating cutting tool along a first circuit of a pre-determined continuous spiral path. The curved edge surface is abraded by contacting a convex section of the rotating cutting tool along additional circuits of the first pre-determined continuous spiral path. The pitch of vertical movement of the cutting tool is adjusted for each circuit of the continuous spiral path based on a resulting curvature of the metal alloy casing. The bottom surface is abraded by contacting a flat section of the cutting tool along a second pre-determined alternating direction linear path.

14 Claims, 9 Drawing Sheets

(56) References Cited

U.S. PATENT DOCUMENTS

| | | | | |
|---|---|---|---|---|
| 4,193,227 | A * | 3/1980 | Uhtenwoldt | 451/5 |
| 4,492,059 | A * | 1/1985 | Panetti | 451/347 |
| 4,574,527 | A * | 3/1986 | Craxton | 451/5 |
| 4,800,686 | A * | 1/1989 | Hirabayashi et al. | 451/41 |
| 4,977,709 | A * | 12/1990 | Siden | 451/541 |
| 5,033,237 | A * | 7/1991 | Slough et al. | 451/5 |
| 5,231,587 | A * | 7/1993 | Frost | 700/164 |
| 5,419,626 | A | 5/1995 | Crockett | |
| 5,662,515 | A * | 9/1997 | Evensen | 451/59 |
| 5,865,668 | A * | 2/1999 | Stewart | 451/28 |
| 5,895,311 | A * | 4/1999 | Shiotani et al. | 451/5 |
| 6,266,019 | B1 | 7/2001 | Stewart et al. | |
| 6,343,945 | B1 | 2/2002 | Liikanen | |
| 6,490,435 | B1 | 12/2002 | Ma et al. | |
| 6,560,092 | B2 | 5/2003 | Itou et al. | |
| 6,729,893 | B2 | 5/2004 | Ezaki | |
| 6,749,448 | B2 | 6/2004 | Bright et al. | |
| 6,791,825 | B1 | 9/2004 | Taylor | |
| 6,842,333 | B2 | 1/2005 | Lee et al. | |
| 7,145,769 | B2 | 12/2006 | Chen | |
| 7,232,181 | B2 | 6/2007 | Schmucker | |
| 7,331,793 | B2 | 2/2008 | Hernandez et al. | |
| 7,494,305 | B2 * | 2/2009 | Riall et al. | 409/132 |
| 7,633,747 | B2 | 12/2009 | Yang et al. | |
| 7,652,877 | B2 | 1/2010 | Nishizawa | |
| 7,697,281 | B2 | 4/2010 | Dabov et al. | |
| 7,821,782 | B2 | 10/2010 | Doherty et al. | |
| 7,839,658 | B2 | 11/2010 | Kim | |
| 7,852,626 | B2 | 12/2010 | Eldershaw | |
| 7,896,728 | B2 * | 3/2011 | Schwartz et al. | 451/53 |
| 7,921,553 | B2 | 4/2011 | Wojack et al. | |
| 7,947,900 | B2 | 5/2011 | Cheng et al. | |
| 7,971,464 | B2 | 7/2011 | Hachino et al. | |
| D642,563 | S | 8/2011 | Akana et al. | |
| 8,007,551 | B2 * | 8/2011 | Kaneuchi et al. | 51/293 |
| 8,081,430 | B2 | 12/2011 | Weber et al. | |
| 8,260,377 | B2 | 9/2012 | Paleczny et al. | |
| 8,305,741 | B2 | 11/2012 | Chatterjee | |
| 8,345,410 | B2 | 1/2013 | Ternus et al. | |
| 8,360,824 | B2 * | 1/2013 | Harada et al. | 451/41 |
| 8,363,399 | B2 | 1/2013 | Sonehara et al. | |
| 8,421,689 | B2 | 4/2013 | Schlub et al. | |
| 8,430,256 | B2 | 4/2013 | Allore et al. | |
| 2002/0085342 | A1 | 7/2002 | Chen et al. | |
| 2006/0111032 | A1 * | 5/2006 | Weston et al. | 451/557 |
| 2007/0049175 | A1 * | 3/2007 | Kim et al. | 451/11 |
| 2007/0081303 | A1 | 4/2007 | Lam et al. | |
| 2007/0157993 | A1 * | 7/2007 | Yoon | 144/371 |
| 2009/0040703 | A1 | 2/2009 | Gotham et al. | |
| 2009/0042495 | A1 * | 2/2009 | Cho et al. | 451/461 |
| 2009/0094903 | A1 * | 4/2009 | Choul et al. | 51/309 |
| 2009/0197116 | A1 | 8/2009 | Cheng et al. | |
| 2009/0257189 | A1 | 10/2009 | Wang et al. | |
| 2010/0008514 | A1 | 1/2010 | Bates et al. | |
| 2010/0056231 | A1 | 3/2010 | Weiss et al. | |
| 2010/0076583 | A1 | 3/2010 | Wojack et al. | |
| 2010/0091442 | A1 | 4/2010 | Theobald et al. | |
| 2010/0132728 | A1 * | 6/2010 | Busch | 132/75.8 |
| 2010/0159803 | A1 * | 6/2010 | Shore et al. | 451/5 |
| 2011/0007461 | A1 | 1/2011 | Moskowitz et al. | |
| 2011/0189924 | A1 * | 8/2011 | Erickson | 451/5 |
| 2011/0297578 | A1 | 12/2011 | Stiehl et al. | |
| 2012/0194393 | A1 | 8/2012 | Uttermann et al. | |
| 2012/0194998 | A1 | 8/2012 | McClure et al. | |
| 2013/0223836 | A1 | 8/2013 | Gibbs et al. | |

FOREIGN PATENT DOCUMENTS

| | | |
|---|---|---|
| TW | 200616414 | 5/2006 |
| TW | M313872 | 6/2007 |
| TW | 200725979 | 7/2007 |
| WO | 2009/126480 | 10/2009 |

* cited by examiner

APPARATUS FOR SHAPING EXTERIOR SURFACE OF A METAL ALLOY CASING

CROSS-REFERENCE TO RELATED APPLICATIONS

This patent application is related to and incorporates by reference in their entireties for all purposes the following co-pending patent applications filed concurrently herewith:

(i) U.S. patent application Ser. No. 13/018,239 (APL1P799/P10574US1) entitled "FLAT OBJECT EJECTOR ASSEMBLY" by Jules Henry et al., issued as U.S. Pat. No. 8,460,018;

(ii) U.S. patent application Ser. No. 13/018,174 (APL1P802/P10574US2) entitled "HANDHELD PORTABLE DEVICE" by Stephen R. McClure et al., issued as U.S. Pat. No. 8,587,939;

(iii) U.S. patent application Ser. No. 13/018,184 (APL1P803/P10574US3) entitled "ANTENNA, SHIELDING AND GROUNDING" by Erik A. Uttermann et al.;

(iiv) U.S. patent application Ser. No. 13/018,153 (APL1P804/P10574US4) entitled "COMPONENT ASSEMBLY" by Stephen R. McClure et al., issued as U.S. Pat. No. 8,570,736.

TECHNICAL FIELD

The present invention relates generally to the machining of a three dimensional metal alloy object. More particularly, a method and an apparatus are described for machining an exterior surface of a metal alloy casing of a portable electronic device to form a combination of a flat top edge surface, a curved edge surface and a flat bottom surface.

BACKGROUND OF THE INVENTION

The proliferation of high volume manufactured, portable electronic devices has encouraged innovation in both functional and aesthetic design practices for enclosures that encase such devices. Manufactured devices can include a casing that provides an ergonomic shape and aesthetically pleasing visual appearance desirable to the user of the device. Exterior surfaces of metal alloy casings of portable electronic devices can be shaped by computer numerically controlled machinery and can include combinations of flat regions and curved regions. To minimize weight of the portable electronic device, the metal alloy casing can be shaped to a minimal thickness while maintaining sufficient mechanical rigidity to avoid minor impact damage. As the thickness of the metal alloy casing can be quite thin, for example fractions of a millimeter, the shaping of the exterior casing can require precise and repeatable results to minimize surface variation on the exterior of the casing. Irregularities in the surface can result in a metal alloy casing having an unacceptable appearance or compromised mechanical integrity. In addition, high volume manufacturing can require minimal time for shaping of the metal alloy casing. Multiple separate tools to shape different regions of the metal alloy casing can require additional manufacturing time than machining using a single cutting tool along a single continuous path. Thus there exists a need for a method and an apparatus for machining a three dimensional top surface, edge surface and bottom surface of a metal alloy casing resulting in a surface with a consistent surface variation within a tolerance required to achieve a desired minimal thickness casing and preferred surface appearance upon finishing.

SUMMARY OF THE DESCRIBED EMBODIMENTS

In one embodiment, an apparatus for shaping an exterior surface of a metal alloy casing of a portable electronic device is disclosed. The apparatus includes a cutting tool having at least three cutting surfaces for abrading regions of the metal alloy casing. The apparatus also includes a computer numerically controlled (CNC) positioning assembly configured to rotate the cutting tool at a constant rotational velocity and to contact the rotating cutting tool along a pre-determined continuous path at a constant translational velocity to abrade the metal alloy casing. The at least three cutting surfaces of the cutting tool include a first flat cutting surface, a curved convex shaped cutting surface and a second flat cutting surface. The first flat cutting surface is nearest a neck of the cutting tool and shapes a flat edge region on the top of the metal alloy casing. The curved convex shaped cutting surface is adjacent to the first flat cutting surface and shapes a curved edge region of the metal alloy casing. The second flat cutting surface is on the bottom of the cutting tool adjacent to the curved convex shaped cutting surface and shapes a flat bottom region of the metal alloy casing. The pre-determined continuous path includes a continuous spiral path to shape the flat edge region of the metal alloy casing and a continuous zigzag path used to shape the flat bottom region of the metal alloy casing. The spacing between adjacent circuits of the continuous spiral path varies based on a curvature of a cross section of the surface of the metal alloy casing.

In one embodiment, an apparatus for shaping an exterior surface of a metal alloy casing of a portable electronic device includes a bell shaped cutting tool and a computer numerically controlled (CNC) positioning assembly. The bell shaped cutting tool includes multiple cutting surfaces for abrading different regions of the metal alloy casing. The CNC positioning assembly is configured to rotate the bell shaped cutting tool at a constant rotational velocity and to contact the rotating bell shaped cutting tool along a pre-determined path to abrade the metal alloy casing. Adjacent cutting surfaces of the cutting tool are used to shape adjacent regions on the exterior surface of the metal alloy casing.

In one embodiment, a non-transitory computer readable medium for storing non-transitory computer program code executed by a processor for controlling a computer aided manufacturing operation for shaping an exterior surface of a metal alloy casing is disclosed. The non-transitory computer readable medium includes at least the following non-transitory computer program code. Non-transitory computer program code arranged to abrade an edge surface of the metal alloy casing by contacting a rotating cutting tool along a first pre-determined continuous spiral path along the edge surface. Additional non-transitory computer program code arranged to adjust the vertical movement of the cutting tool in a direction perpendicular to a bottom surface of the metal alloy casing for each circuit of the continuous spiral path. Further non-transitory computer program code arranged to abrade the bottom surface of the metal alloy casing by contacting the rotating cutting tool along a second pre-determined zigzag path against the bottom surface.

In one embodiment, a method for machining an edge surface and a bottom surface of a metal alloy casing of a portable electronic device includes at least the following steps. A first step includes abrading the edge surface of the metal alloy casing by contacting a rotating cutting tool along a first pre-determined continuous spiral path against the edge surface. A second step includes adjusting the pitch of vertical movement of the cutting tool for each circuit of the continuous spiral path based on a resulting curvature of the metal alloy casing perpendicular to the direction of the continuous spiral path along the surface of the metal alloy casing. A third step includes abrading the bottom surface of the metal alloy casing by contacting the rotating cutting tool along a second pre-determined alternating direction linear path against the bottom surface.

BRIEF DESCRIPTION OF THE DRAWINGS

The invention and the advantages thereof may best be understood by reference to the following description taken in conjunction with the accompanying drawings.

DETAILED DESCRIPTION OF EXAMPLE EMBODIMENTS

The present invention relates generally to the machining of a three dimensional metal alloy object. More particularly, a method and an apparatus are described for machining an exterior surface of a metal alloy casing of a portable electronic device to form a combination of a flat top edge surface, a curved edge surface and a flat bottom surface.

In the following description, numerous specific details are set forth to provide a thorough understanding of the present invention. It will be apparent, however, to one skilled in the art that the present invention may be practiced without some or all of these specific details. In other instances, well known process steps have not been described in detail in order to avoid unnecessarily obscuring the present invention.

High volume manufactured portable electronics devices can include computer numerically controlled (CNC) machined metal alloy parts with various geometrically shaped surfaces. Representative portable electronic devices can include portable media players, portable communication devices, and portable computing devices, such as an iPod®, iPhone® and iPad® manufactured by Apple, Inc. of Cupertino, Calif. Both the tactile and visual appearance of a portable electronics device can enhance the desirability of the portable electronic device to the consumer. Metal alloys can provide a lightweight material that exhibits desirable properties, such as strength and heat conduction well suited for casings of portable electronic devices. A representative metal alloy can include an aluminum alloy. Both the tactile and visual appearance of a portable electronics device can enhance the desirability of the device to the consumer. A cosmetic outer layer machined from a metal alloy can be cut to a desired shape and polished to a desired reflective and/or matte appearance. In some embodiments, a continuously smooth shape having a uniformly visually smooth appearance can be desired.

High volume manufacturing can also require minimal processing time. Machining an aluminum billet to form the exterior surface of a casing of a portable electronic device using a single cutting tool can reduce the processing time required. Machining with a single continuous optimized path can result in a "rough" cut surface that can require minimal sanding and polishing to produce a visually smooth finish with no visually discernible breaks between regions having different cross sections. Curved regions can transition smoothly into flat regions including along corner areas without any visual change in surface appearance.

Figure 1:
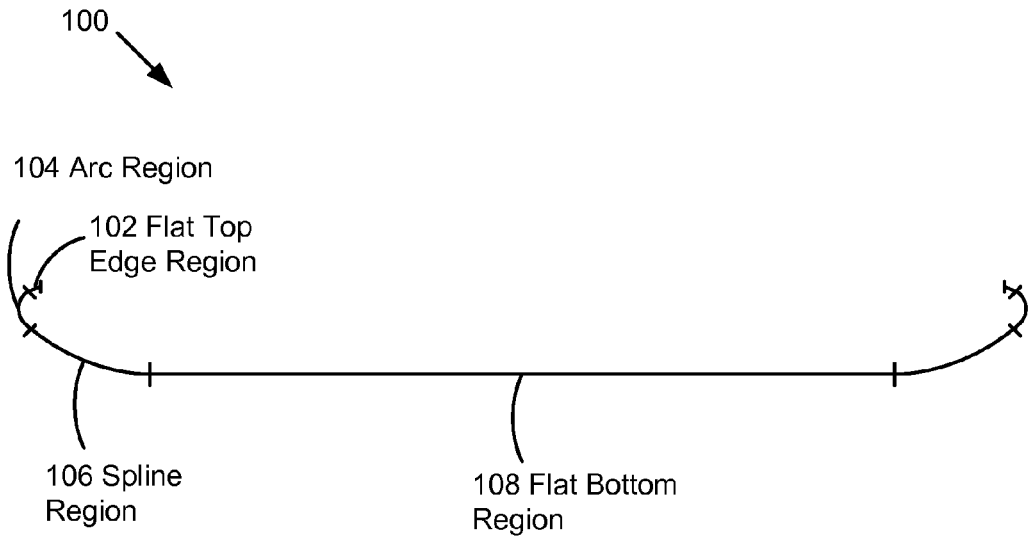
FIG. 1 illustrates a simplified cross sectional side view of a casing for a portable electronic device including a shaped geometric edge.

FIG. 1 illustrates a cross section of a representative embodiment of a casing 100 for a portable electronic device. The cross section illustrates a shape for the surface of the casing 100 that can include four distinct regions including a first flat top edge region 102 that can be linear in cross section adjacent to an opening in the top of the casing 100 into which components for the portable electronic device can be placed. The flat top edge region 102 can face a user of the portable electronic device when viewed directly from above a display mounted in the portable electric device. The flat top region 102 can be shaped by a single continuous cut of a machining tool and polished to a highly reflective surface appearance. The flat top region 102 can also be referred to as a "race track" edge. The cross section of the casing 100 can also include two curved regions connected together, an arc-shaped region 104 that can transition from the flat top edge region 102 to a spline-shaped region 106. The arc region 104 can have a relatively higher curvature than the spline region 106. The cross section of the casing 100 can also include a flat bottom region 108, which can transition smoothly from the spline region 106. A single cutting tool having multiple cutting surfaces can be used to shape the exterior surface of the casing 100 to have the cross section illustrated in FIG. 1 using a single continuous cutting path as described herein.

Figure 2:
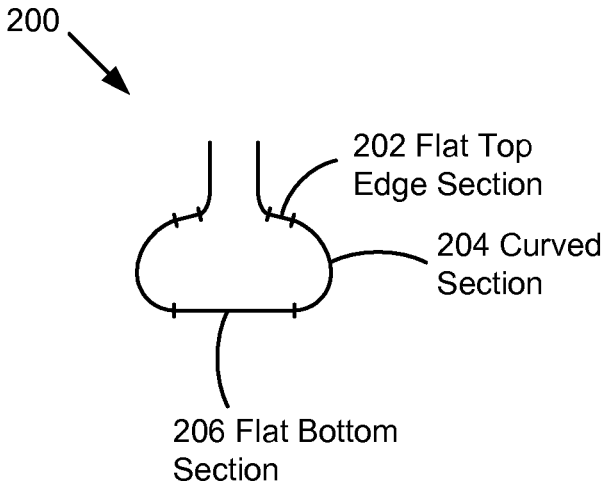
FIG. 2 illustrates a simplified cross section of a cutting tool to shape an exterior surface of the casing of FIG. 1.
Figure 3A:
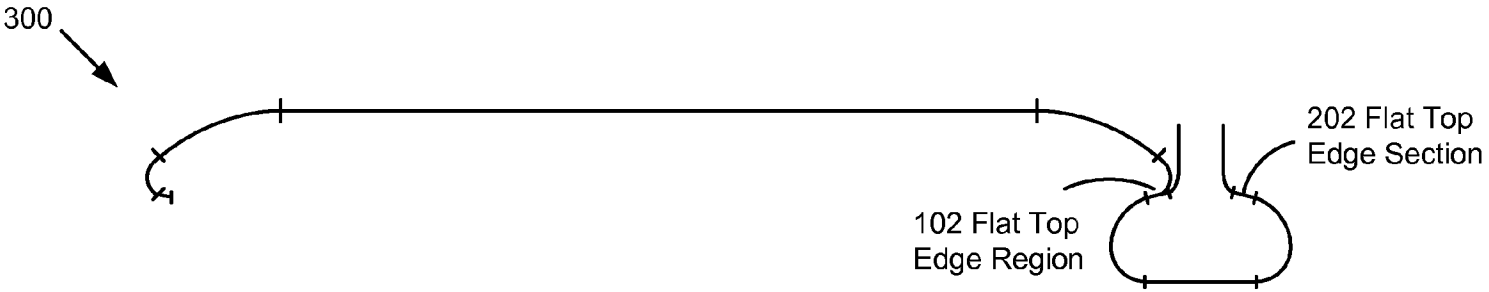
FIGS. 3A-D illustrate positioning of different sections of the cutting tool to shape different regions of the exterior surface of the casing of FIG. 1.
Figure 3B:
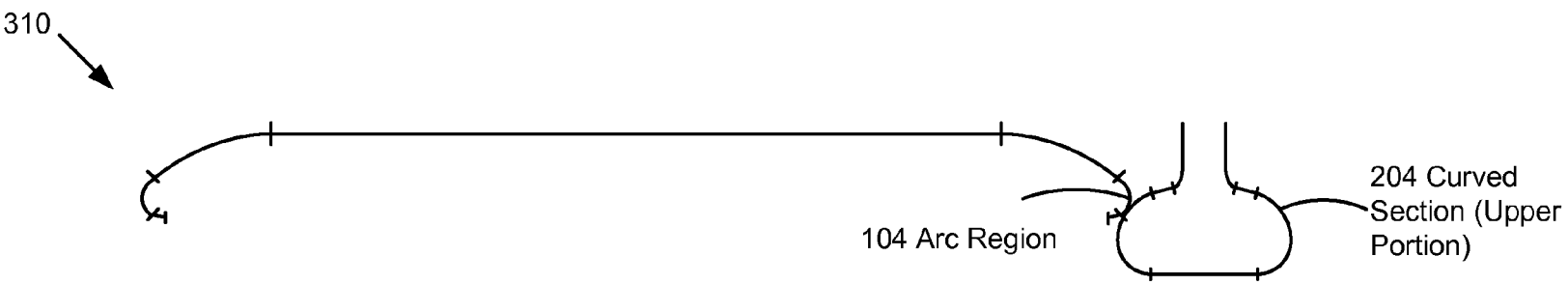
Figure 3C:
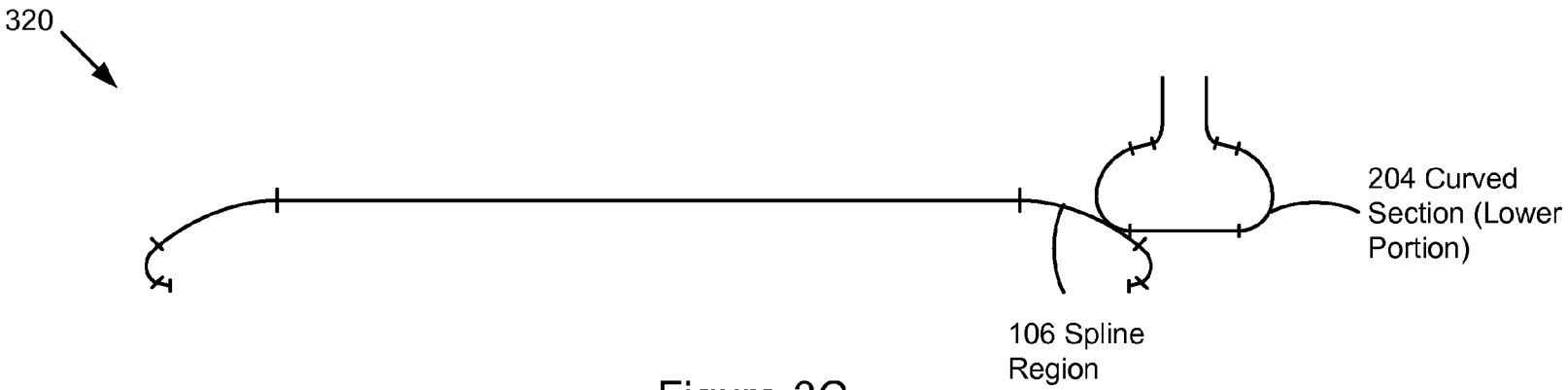
Figure 3D:
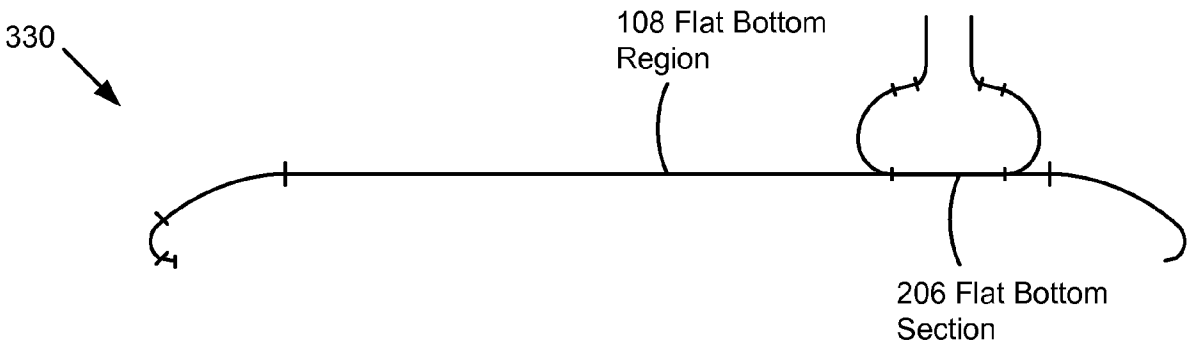

FIG. 2 illustrates a cross section of a representative cutting tool 200 having three different sections, each section can be shaped to provide a cutting surface to machine one or more of the regions of the casing 100 of the portable electronic device shown in FIG. 1. The cutting tool 200 can be mounted in a CNC machine, rotated at a constant velocity and positioned in different orientations within a three dimensional coordinate system to shape a metal alloy billet into a desired exterior surface shape. In particular the CNC machinery can allow movement in a "z" direction to provide a plunge (negative "z") and a rise (positive "z"). The CNC machinery can also permit movement in an "x-y" direction tracing a pre-determined continuous path. A flat top edge section 202 of the cutting tool 200 can be used to shape the flat top edge region 102 of the casing 100. A curved section 204 of the cutting tool 200 can be used to shape the arc region 104 and the spline region 106, while a flat bottom section 206 of the cutting tool 200 can be used to shape the flat bottom region 108 of the casing 100. The curved section 204 of the cutting tool 200 can be convex shaped, as can be the curved regions of the casing 100 shaped by the curved section 204 of the cutting tool 200. Each of the adjacent regions of the cutting tool 200 can be used consecutively one after the other, with the cutting tool 200 moving along a continuous pre-determined path. Varying the "z" direction of the path carefully can minimize abrupt transitions between regions along the surface of the casing 100 when changing between using different sections of the cutting tool 200. The "z" direction can be normal to the bottom surface of the casing 100, while the "x-y" directions can be along the edge and bottom surfaces of the casing 100.

FIGS. 3A-D illustrates several positions for the cutting tool 200 to shape different regions of the casing 100 using different surfaces of the cutting tool 200. As shown by diagram 300 in FIG. 3A, the flat top edge section 202 closest to the neck of the cutting tool 200 can be positioned to shape the flat top edge region 102 of the casing 100. The flat top edge region 102 can be formed along one continuous path. After shaping the flat top edge region 102, the cutting tool 200 can transition to shape the curved regions of the casing 100. As shown by diagram 310 in FIG. 3B, an upper portion of the curved section 204 of the cutting tool 200 closest to the flat top edge section 202 can be used to form the arc region 104 of the casing 100. As shown by diagram 320 in FIG. 3C, a lower portion of the curved section 204 of the cutting tool 200 can be used to shape the spline region 106 of the casing 100. The curved section 204 of the cutting tool 200 can continuously shift in orientation with respect to the casing 100 as the CNC machinery moves the cutting tool 200 along the surface of the exterior of the casing 100. As the CNC machinery lifts the cutting tool 200 to rise in the "z" direction, different portions of the curved section 204 of the cutting tool 200 can contact and shape different regions of the casing 100. While not shown in the diagram, the CNC machinery can also tilt the cutting tool at different angles when cutting the surface of the casing 100. As shown by diagram 330 in FIG. 3D, the flat bottom section 206 of the cutting tool 200 can be used to form the flat bottom region 108 of the casing 100. The CNC machinery can move the cutting tool 200 in a continuous spiral path to form the flat top region 102, the arc region 104 and the spline region 106. The rise in the "z" direction can be varied to ensure a uniform surface for the shaped casing 100 with no visible joins or transitions after sanding and polishing the rough cut surface of the casing 100 formed by the machining.

Figure 4:
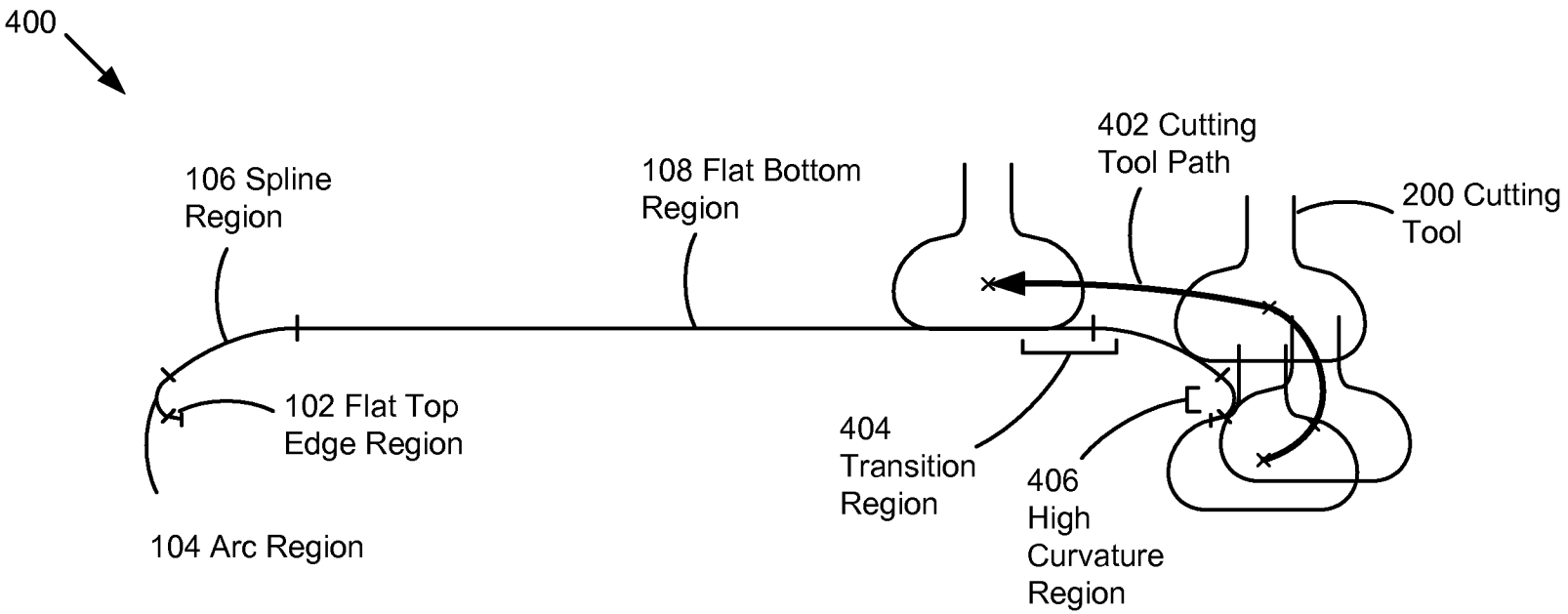
FIG. 4 illustrates a vertical path of the center of the cutting tool for successive circuits of a spiral path when shaping the exterior surface of the casing of FIG. 1.

The path of the cutting tool 200 can be chosen to provide transitions between different regions of the casing 100 without abrupt changes in a frictional force of contact between the cutting tool 200 and the casing 100. By ensuring a uniform smoothly changing frictional load and constant force of contact between the cutting tool 200 and the casing 100 during the transition between regions, the surface of the casing 100 can be shaped without irregular cuts, such as gouges, indentations or surface warps that can mar the finish of the surface of the casing 100. A continuous spiral path for the cutting tool 200 can maintain a smooth transition between different regions. The frictional load experienced by the cutting tool 200 can vary with the amount of surface area contacted between the cutting tool 200 and the casing 100. Critical regions of the surface of the casing 100 at which special care can be taken to determine the cutting tool path include the transition regions between different shapes of the cross section of the surface of the casing 100. Narrowing the spacing between successive circuits for a continuous spiral path taken by the cutting tool 200 can minimize abrupt changes in the frictional load thereby ensuring a uniform cut surface of the casing 100. Transition regions can include the transition from the flat top edge region 102 to the arc region 104, the arc region 104 to the spline region 106, and the spline region 106 to the flat bottom region 108. FIG. 4 illustrates a diagram 400 of a transition region 404 between the spline region 106 and the flat bottom region 108 for a cutting tool path 402, which indicates a movement of a center of the cutting tool 200. Cross sectional areas of the surface of the casing 100 that can include high curvature, such as a high curvature region 406 in the arc region 104 can also benefit from a narrowing of the spacing between successive circuits of the continuous path of the cutting tool 200.

Figure 5:
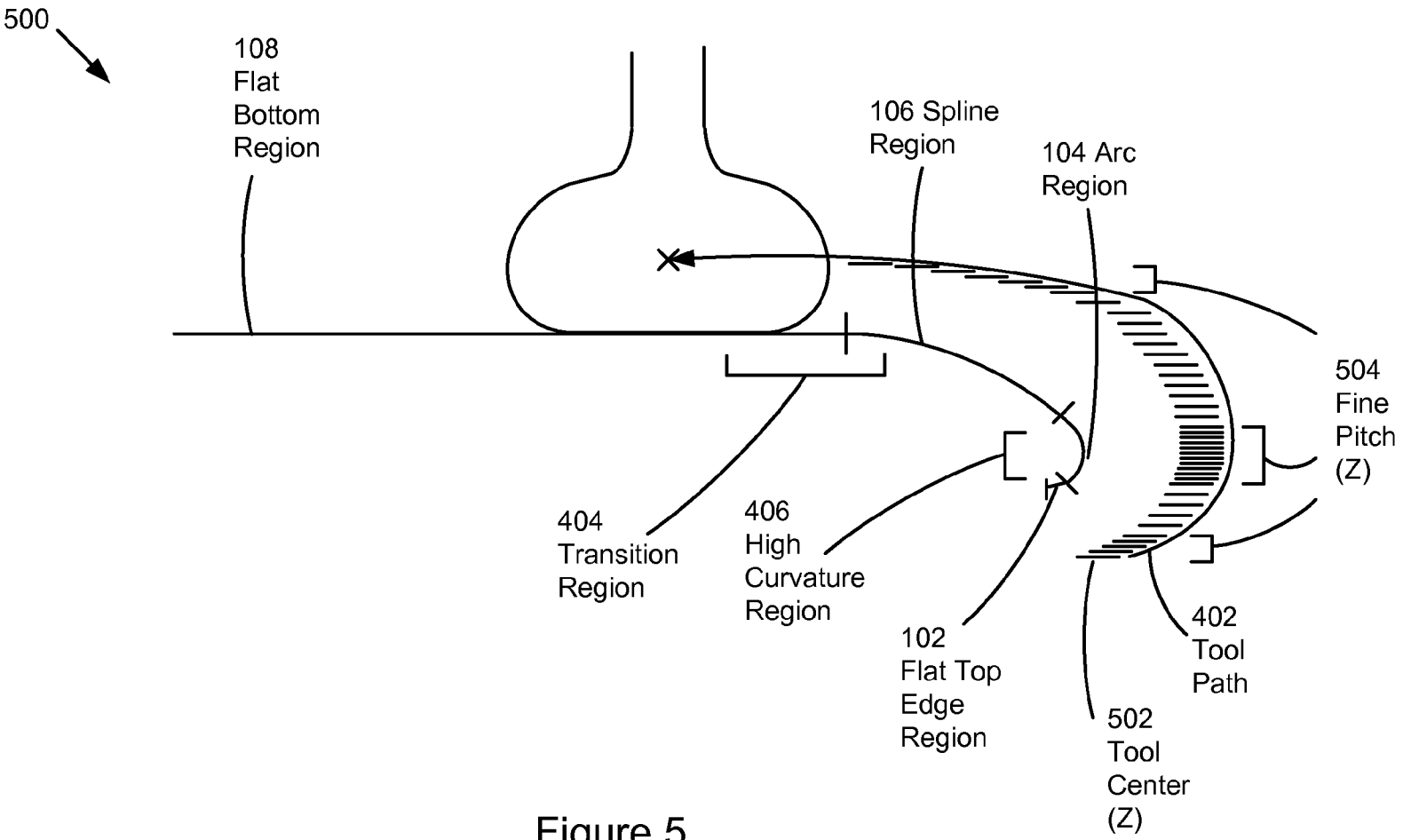
FIG. 5 illustrates variable spacing for successive circuits of the spiral path when shaping the exterior surface of the casing of FIG. 1.

FIG. 5 illustrates a diagram 500 with the tool path 402 having variable pitch in the "z" direction that can be used for successive circuits of the cutting tool 200 along the continuous spiral path. The tool path center 502 can approximately follow the shape of the surface of the casing 100 as the cutting tool 200 shapes the casing 100 from a solid metal alloy block, such as an aluminum billet. The cutting tool 200 can follow a continuous spiral path about the casing 100, slowly increasing the "z" height as the cutting tool 200 traverses along the continuous spiral path. FIG. 5 illustrates how the "z" height 502 of the center of the cutting tool 200 can vary for successive circuits about the continuous spiral path. When transitioning from the flat top edge region 102 to the arc region 104, the tool path 402 can step in the "z" direction narrowly with a fine pitch 504. Following the transition the tool path 402 can step in the "z" direction more widely to speed machining of the casing 100. The narrow spacing of successive circuits of the cutting tool 200 can minimize and avoid abrupt changes in friction between the cutting tool 200 and the surface of the casing 100.

In addition to fine spacing in transition regions, the CNC machining through the high curvature region 406 of the arc region 104 can use a fine pitch 504 "z" spacing between successive circuits of the continuous spiral path. Spacing the circuits close together can avoid sharp transitions in frictional contact and provide a smooth even cutting in the arc region 104. Similar to the fine spacing in the transition between the flat top edge region 102 to the arc region 104, the cutting tool path 402 can also be spaced with a fine pitch 504 in the "z" direction throughout the transition region 404 from the spline region 106 to the flat bottom region 108. The surface area of the cutting tool 200 in contact with the surface of the casing 100 can increase substantially from the spline region 106 to the flat bottom region 108, and by spacing the circuits closer together the transition from minimal contact to broader contact can proceed smoothly to avoid gouging the casing 100 while machining. Close spacing of the paths in the transition region 404 can also eliminate visible transitions between the curved surface of the spline region 106 and the flat surface of the flat bottom region 108. After cutting, sanding and polishing, the casing 100 of the mobile device can have a uniform smooth appearance without noticeable differences between the curved edge surfaces and the flat bottom surface and no visible joins. Once the flat bottom section 206 of the cutting tool 200 is completely within the flat bottom region 108 of the casing 100, the continuous path taken by the cutting tool 200 can change from a spiral path to a zigzag path, i.e. a path with alternating linear paths, across the flat bottom region 108. The zigzag path can minimize warping that can occur due to temperature changes in the metal alloy on the surface of the casing 100 during machining. With the careful placement of the tool path 502 using fine pitch spacing along select regions, the sanded and polished surface of the casing 100 can have a visually continuous surface without edges or corners when viewed from the back.

Figure 6:
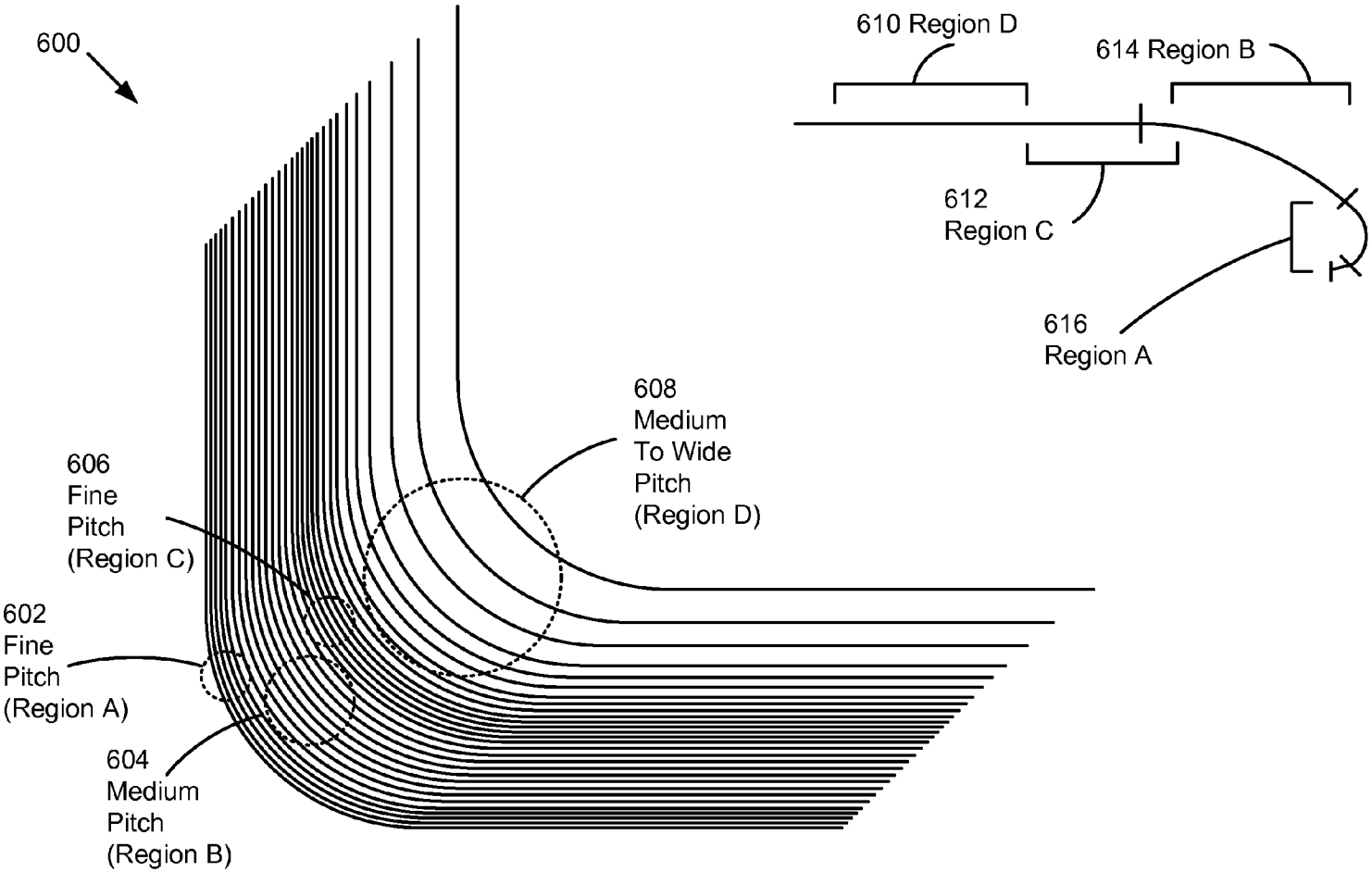
FIG. 6 illustrates a top view of a portion of successive circuits of the spiral path of FIG. 5.

FIG. 6 illustrates a diagram 600 of a portion of successive circuits of a continuous spiral path of the cutting tool 200 along the surface of the casing 100 matching pitch of spacing to different regions of the casing 100. In a region A 616 of the casing 100, which can include the flat top edge region 102 and the arc region 104, adjacent circuits of the continuous spiral path can be spaced with a fine pitch 602. The fine pitch 602 can ensure a smooth transition between the flat top edge region 102 and the arc region 104 as well as smooth transitions throughout the high curvature region 406 of the arc region 104. In a region B 614 of the casing 100 that can be completely contained within the spline region 106, the spacing of successive circuits of the continuous spiral path can use a medium pitch 604. The curvature of the spline region 106 can be less than the curvature in the arc region 104 and the curvature can change more slowly within the spline region 106 as well. Wider spacing of successive circuits of the continuous spiral path in the region B 614 can speed machining of the casing 100 rather than using a narrow spacing of successive circuits as used in region A 616.

Figure 7:
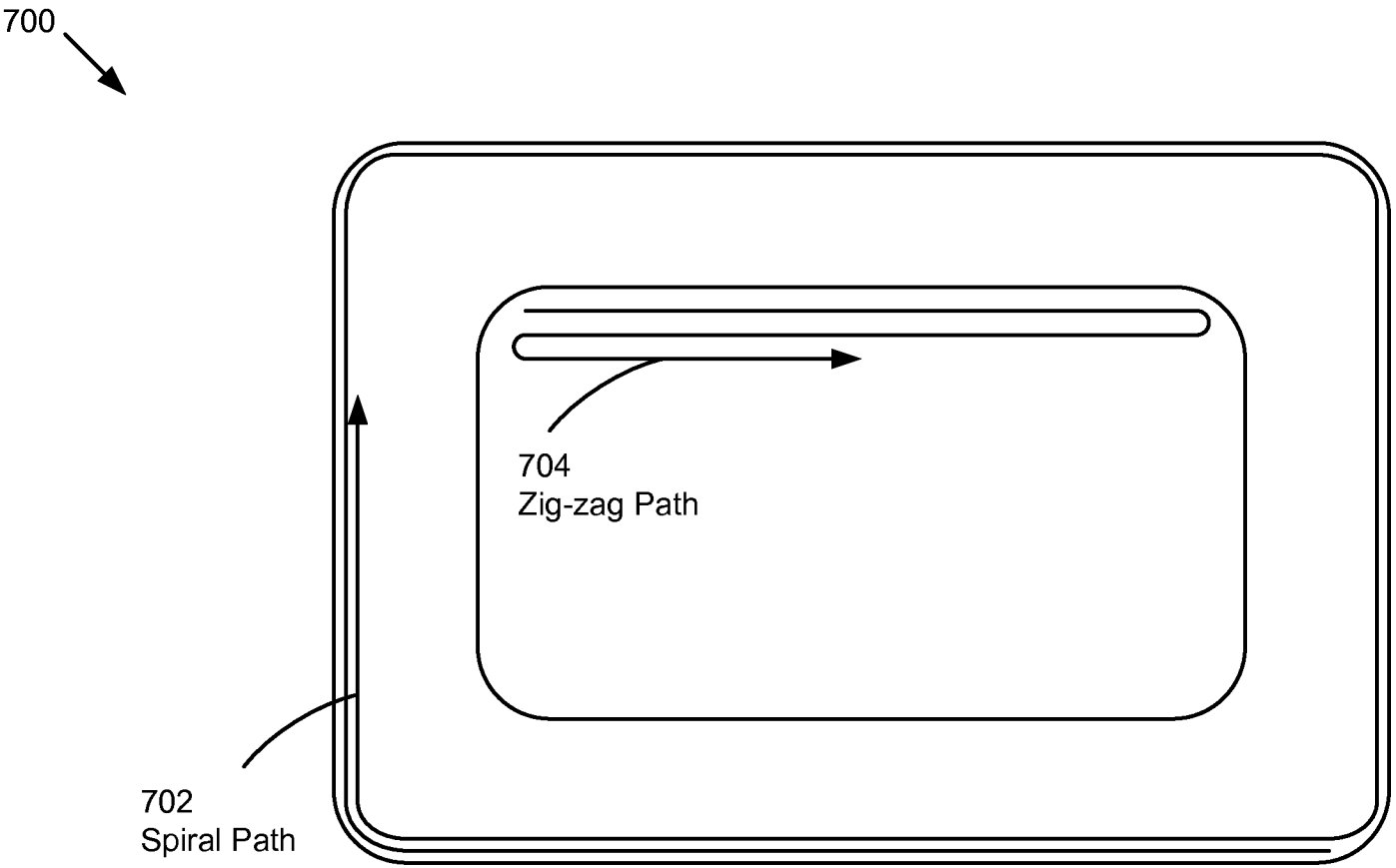
FIG. 7 illustrates a portion of a spiral path for one region and a portion of a zigzag path for a second region of the exterior surface of the casing of FIG. 1.

As the spline region 106 joins up to the flat bottom region 108, the cutting tool 200 can transition from using the curved section 204 to using the flat bottom section 206. The amount of contact between the cutting tool 200 and the surface of the casing 100 can increase substantially throughout the transition in a region C 612 that spans from the spline region 106 to the flat bottom region 108. The spacing between successive circuits of the continuous spiral path can be spaced with a fine pitch 606 within region C 612 in order to increase the contact slowly and to avoid a sudden change in frictional force encountered by the cutting tool 200 while shaping the surface of the casing 100 in region C 612. Within region D 610 of the flat bottom region 108, the spacing between adjacent paths can increase gradually from the fine pitch used in region C 612 to a wider pitch suitable for the flat bottom region 108. After reaching approximately one quarter of the distance into the flat bottom region 108, the CNC machinery can execute a large radius turn to transition from the continuous spiral path used for the curved edge regions 104/106 of the casing 100 to a continuous zigzag path used for the bottom region 108 of the casing 100. The large radius turn can avoid a sharp turn transition that can affect the shaped surface of the casing 100. As shown by the bottom view diagram 700 in FIG. 7, the continuous path can include a spiral path 702 for the curved edge regions 104/106 and a zigzag path 704 for the center of the flat bottom region 108. The spacing between adjacent paths in the zigzag path 704 can be wider than the spacing of adjacent circuits of the spiral path 702.

In one embodiment, the rotational speed and the translational speed along the continuous path of the cutting tool 200 can be fixed. In some embodiments, one or more properties of the cutting tool 200 can be selected (fixed or variable along the cutting path) from the following: the properties can include but can be not limited to (1) feed rate (translational speed in one or more of the x-axis, y-axis and/or z-axis directions), (2) spindle speed (rotational speed), (3) pitch (spacing between adjacent cutting paths), (4) cutting tool 200 shape and size, e.g. diameter, (5) cutting tool 200 cutting material and (6) cutting tool 200 rake angle (angular orientation of cutting tool 200 with respect to casing 100 surface). The properties of the cutting tool 200 can be chosen to affect the machining time and resulting properties of the cut surface of the machined casing 100. The rotational and translational speeds can be selected to minimize machining time while ensuring a quality of surface cut by the machining tool that can result in a preferred surface finish. A fine and tight control of the variation in pitch between circuits of the continuous spiral path can be used in areas with higher curvature, in areas with a higher rate of change in curvature and/or in areas of transition between regions of the surface having different curvatures. A coarser control of the spacing between adjacent paths can be used in flat regions, in regions with low curvature and in regions with a low rate of change in curvature. A medium control can be used in areas of moderate curvature, and the pitch can change continuously and smoothly between regions of fine narrower pitch and regions of coarse wider pitch. While using a fine control of pitch throughout the continuous path can provide a finished surface having a desired uniformity, the time for machining can be longer. Instead the pitch can be controlled to finely step where required to ensure smooth transitions between regions with different cross sectional shapes.

In one embodiment, a single cutting tool 200 can be used to shape the entire exterior surface of the metal alloy casing 100 rather than multiple separate tools to shape the flat and curved regions. The single cutting tool 200 can transition smoothly between different sections on the cutting tool 200 to shape different regions of the metal alloy casing 100 while maintaining continuous contact with the surface of the casing 100. Multiple cutting tools can require additional time to mount and dismount them on the CNC machinery. In addition different cutting tools can result in a mismatch in surface elevation across the shaped casing 100 with undesirable step transitions that can be difficult to remove during the final finishing of the surface of the casing 100. The shaped casing 100 when sanded and polished to a final exterior finish can have a more uniform and seamless appearance using the single cutting tool 200 with a single continuous path as described herein.

Figure 8:
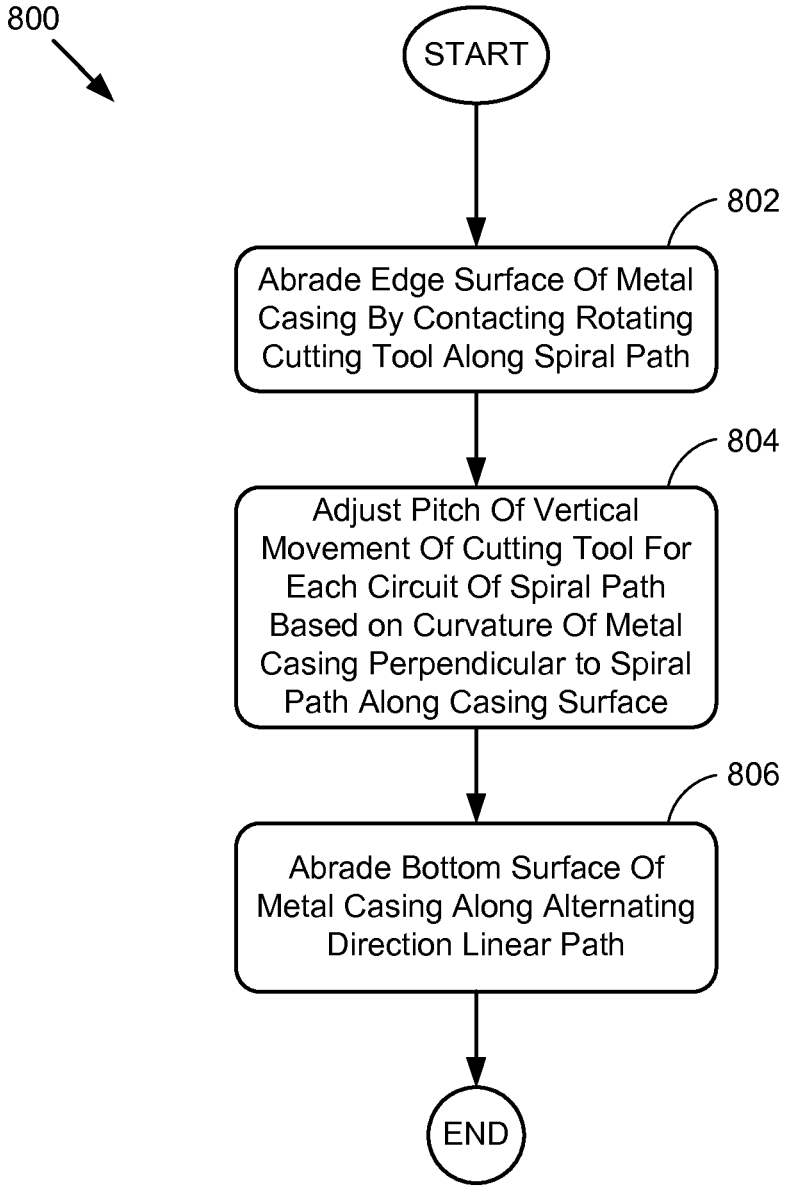
FIG. 8 illustrates a representative method for shaping the exterior surface of the casing of FIG. 1.

FIG. 8 illustrates a representative method to machine an edge surface and a bottom surface of the metal alloy casing 100 of a portable electronic device. The method can include abrading the edge surface of the metal alloy casing 100 by contacting a rotating cutting tool 200 along a first pre-determined continuous spiral path against the edge surface. The vertical height of the cutting tool 200 can be adjusted using CNC machinery. Successive circuits of the spiral path of the cutting tool 200 can be spaced differently along different regions of the surface of the metal alloy casing 100. The pitch of vertical movement, which can affect the spacing between adjacent paths in the continuous spiral path, can be adjusted based on the curvature of the metal alloy casing 100 resulting from the shaping by the cutting tool 200. Areas of high curvature can have closely spaced adjacent paths, as can areas of transition between curved regions and flat regions. The method can also include abrading the bottom surface of the metal alloy casing 100 by contacting the rotating cutting tool 200 along a second pre-determined path having alternating linear paths (i.e. a continuous zigzag path) against the bottom surface of the casing 100. The spacing between adjacent paths along the bottom surface can be spaced further apart than the spacing between adjacent paths in the spiral path along the edge surface of the metal alloy casing 100.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line used to fabricate thermoplastic molded parts. The computer readable medium is any data storage device that can store data which can thereafter be read by a computer system. Examples of the computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. It will be apparent to one of ordinary skill in the art that many modifications and variations are possible in view of the above teachings.

The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. An apparatus for shaping an exterior surface of a metal alloy casing of a portable electronic device, the apparatus comprising:

a cutting tool having at least three cutting surfaces for abrading a plurality of regions of the metal alloy casing; and a computer numerically controlled (CNC) positioning assembly configured to rotate the cutting tool at a constant rotational velocity and to contact the rotating cutting tool along a pre-determined continuous path at a constant translational velocity to abrade the metal alloy casing;

wherein the at least three cutting surfaces of the cutting tool include a first flat cutting surface nearest to a neck of the cutting tool to shape a flat edge region on the top of the metal alloy casing;

a curved convex shaped cutting surface adjacent to the first flat cutting surface to shape a curved edge region of the metal alloy casing; and a second flat cutting surface on the bottom of the cutting tool to shape a flat bottom region of the metal alloy casing; and wherein the pre-determined continuous path includes a continuous spiral path used to shape the flat edge region and to shape the curved edge region and a continuous zigzag path to shape the flat bottom region of the metal alloy casing; and wherein a spacing between adjacent circuits of the continuous spiral path varies based on a curvature of a cross section of the surface of the metal alloy casing.

2. An apparatus for shaping an exterior surface of a metal alloy casing of a portable electronic device, the apparatus comprising:

a bell shaped cutting tool having a plurality of cutting surfaces for abrading a plurality of regions of the metal alloy casing; and a computer numerically controlled (CNC) positioning assembly configured to rotate the bell shaped cutting tool at a constant rotational velocity and to contact the rotating bell shaped cutting tool along a pre-determined continuous path to abrade the metal alloy casing; wherein adjacent cutting surfaces of the cutting tool shape adjacent regions on the exterior surface of the metal alloy casing;

wherein:

the cutting tool surfaces include a first flat surface for shaping a flat edge section of the exterior surface of the metal alloy casing, a second curved surface for shaping a curved edge section of the exterior surface of the metal alloy casing, and a third flat surface for shaping a flat bottom section of the exterior surface of the metal alloy casing; and the pre-determined continuous path includes a spiral path along the flat edge section and the curved edge section and an alternating linear path along at least a portion of the flat bottom section of the exterior surface of the metal alloy casing.

3. The apparatus as recited in claim 2 wherein the CNC positioning assembly varies the pitch of vertical movement of the cutting tool along the spiral path based on the curvature of the cross section of the curved edge section.

4. The apparatus as recited in claim 2 wherein the CNC positioning assembly varies the pitch of vertical movement of the cutting tool along the spiral path to minimize abrupt changes in frictional contact between the cutting tool and the exterior surface of the metal alloy casing.

5. The apparatus as recited in claim 2 wherein the CNC positioning assembly varies the distance between successive circuits of the cutting tool along the spiral path based on an area of contact between the cutting tool and the exterior surface of the metal alloy casing.

6. The apparatus as recited in claim 5 wherein the CNC positioning assembly narrows the distance between successive circuits of the spiral path when transitioning between two different surfaces of the cutting tool while shaping the exterior surface of the metal alloy casing.

7. An apparatus for shaping an exterior surface of a metal alloy casing of a portable electronic device, the apparatus comprising:

a bell shaped cutting tool having a plurality of exterior cutting surfaces for abrading a plurality of regions of the metal alloy casing including a flat bottom cutting surface oriented normal to an axis of rotation of the bell shaped cutting tool wherein a continuous curve is positioned between at least two of the exterior cutting surfaces; and a computer numerically controlled (CNC) positioning assembly configured to rotate the bell shaped cutting tool at a constant rotational velocity and to contact the rotating bell shaped cutting tool along a pre-determined continuous path to abrade the metal alloy casing; wherein adjacent exterior cutting surfaces of the cutting tool shape adjacent regions on the exterior surface of the metal alloy casing.

8. The apparatus as recited in claim 7 wherein the exterior cutting surfaces include a first flat surface for shaping a flat edge section of the exterior surface of the metal alloy casing;

a second curved surface for shaping a curved edge section of the exterior surface of the metal alloy casing; and a third flat surface for shaping a flat bottom section of the exterior surface of the metal alloy casing.

9. The apparatus as recited in claim 8 wherein the curved edge section includes a first sub-section having an arc-shaped cross section and a second sub-section having a spline shaped cross section, wherein the arc-shaped cross section has a greater curvature than the spline shaped cross section.

10. The apparatus as recited in claim 8 wherein the pre-determined continuous path includes a spiral path along the flat edge section and the curved edge section and an alternating linear path along at least a portion of the flat bottom section of the exterior surface of the metal alloy casing.

11. The apparatus as recited in claim 10 wherein the CNC positioning assembly varies the pitch of vertical movement of the cutting tool along the spiral path based on the curvature of the cross section of the curved edge section.

12. The apparatus as recited in claim 10 wherein the CNC positioning assembly varies the pitch of vertical movement of the cutting tool along the spiral path to minimize abrupt changes in frictional contact between the cutting tool and the exterior surface of the metal alloy casing.

13. The apparatus as recited in claim 10 wherein the CNC positioning assembly varies the distance between successive circuits of the cutting tool along the spiral path based on an area contact between the cutting tool and the exterior surface of the metal alloy casing.

14. The apparatus as recited in claim 13 wherein the CNC positioning assembly narrows the distance between successive circuits of the spiral path when transitioning between two different surfaces of the cutting tool while shaping the exterior surface of the metal alloy casing.

* * * * *